United States Patent [19]

Jensen

[11] 4,225,435

[45] Sep. 30, 1980

[54] BLOCKING DEVICE FOR USE IN A SEWER MANHOLE

[76] Inventor: Knud Jensen, Gaerumvej 41, 99, 9900 Frederikshavn, Denmark

[21] Appl. No.: 903,957

[22] Filed: May 8, 1978

[30] Foreign Application Priority Data

May 19, 1977 [GB] United Kingdom ..... 21071/77

[51] Int. Cl.[2] ..... B01D 35/04

[52] U.S. Cl. ..... 210/153; 248/225.3 A; 137/527.4; 137/527.8; 52/101

[58] Field of Search ..... 210/121,131, 153, 154, 210/163, 166, 143; 52/20, 101; 404/2, 4, 5; 137/527.4, 527.8; 405/36; 248/216.1, 217.2, 225.3 A, 351, 539

[56] References Cited

U.S. PATENT DOCUMENTS

| | | | |
|---|---|---|---|
| 468,058 | 2/1892 | McNelly | 248/216.1 |
| 999,305 | 8/1911 | Gurnett | 137/527.8 |
| 1,237,428 | 8/1917 | Watrous | 248/217.2 |
| 2,718,941 | 9/1955 | Robinson | 248/539 |
| 3,118,469 | 1/1964 | Schliesser | 137/527.8 |

*Primary Examiner*—Ernest G. Therkorn

*Attorney, Agent, or Firm*—Wegner, Stellman, McCord, Wiles & Wood

[57] ABSTRACT

The invention concerns a blocking device for obstructing the opening of an inlet pipe in a sewer manhole, so that rats and like rodents are restrained. The blocking device comprises a ball or pear-shaped floatable blocking body for automatic blocking of the pipe opening by gravity when there is no flow of waste material into the manhole, said blocking body being pivotally suspended from a supporting means which by means of a tightening member is secured above the pipe opening by being wedged between opposite wall portions of the manhole. The blocking device also has a stopping means for limiting the penetration depth of said blocking body in the inlet pipe.

4 Claims, 3 Drawing Figures

BLOCKING DEVICE FOR USE IN A SEWER MANHOLE

Figure 1:
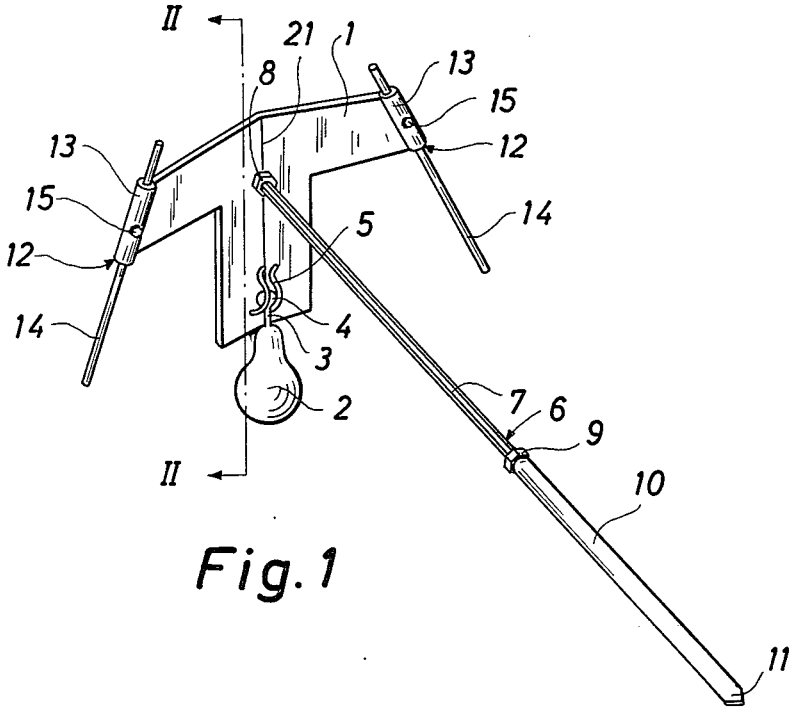

The present invention relates to a blocking device with a floatable blocking body for automatic obstruction of the opening of an inlet pipe in a sewer manhole in order to restrain rats or like rodents from entering the pipes.

It is difficult to prevent rats from gaining access to houses by way of sewer manholes and their connecting pipes. Rats and like rodents which are allowed to run freely through the pipes under houses are a great nuisance. By gaining access to floor gratings and toilet bowls, they may gain easy access to indoor as well as outdoor pipes, which they are capable of gnawing to pieces.

Blocking devices are known which are adapted to prevent rats from passing freely through sewer systems. Such devices consist of a flap, for example, which is pivotally mounted on a horizontal axle extending across the opening of the outlet pipe from a sewer manhole or the like and embedded in the wall of the manhole. Located on the upper part of the flap is a stopping means adapted to abut the surrounding wall of the manhole when rats, trying to force their way into the manhole from the outlet pipe, press against the lower part of the flap. In such known devices, however, there is a relatively great risk of stoppage. Furthermore there is a possibility that the rats will pass through the blocking means either by crawling over the horizontal axle or by grasping the flap and turning it inward into the drain pipe. Moreover such devices are relatively difficult to mount in existing sewer manholes.

The object of the present invention is to bring about a blocking device which can be mounted relatively easily in existing manholes, and which does not cause stoppage or allow the rats to grasp the blocking body and gain access to the inlet pipe of the sewer manhole.

This is achieved according to the invention by a blocking device comprising a substantially freely pivotable blocking body which is suspended from a supporting means located above the opening of an inlet pipe, said supporting means having parts for adjusting the position of the supporting means above the opening of the inlet pipe and being connected to a tightening member adapted to wedge the supporting means into position above the opening of the inlet pipe by pressing against the opposite wall of the sewer manhole, said supporting means furthermore having a stopping means for limiting the penetration depth of the blocking body in the inlet pipe. The blocking device can be mounted in any sewer manhole, regardless of the consistency of the material the manhole wall is made of, because the blocking device does not require holes bored into the wall or any form of preparation of the wall. It is only necessary to adjust the blocking device with the freely pivotable blocking body in relation to the opening of the inlet pipe. It is thereafter wedged into position by the tightening member which presses the supporting means against the opposite wall of the sewer manhole. As the blocking body suspended from the supporting means is freely pivotable, it is consequently easily pushed away from the opening by the liquid flowing into the sewer manhole or by other waste material. Due to the effect of gravity, the blocking body automatically swings back to its blocking position in the opening when there is no flow into the sewer manhole. As the blocking body is not suspended from a means which extends across the opening, there is no risk that it will stop up the opening or allow rats to force their way into the inlet pipe. The latter is true because the axis or point of rotation of the blocking body is located above the opening and for this reason the entire blocking body must be swung away from the opening in order to allow entrance into the inlet pipe. The stopping means ensures that the blocking body cannot be pushed inward into the opening.

According to the invention the blocking body may be substantially ball or pear-shaped and therefore the rats cannot grasp the blocking body and swing it away from the opening.

Furthermore according to the invention the blocking body may be suspended from the supporting means by means of a universal joint, whereby a blocking device is achieved which is suitable for obstructing openings which do not discharge in radial direction into the sewer manhole. The supporting means according to the invention may be a plate which has adjusting parts located on their respective sides of the supporting means, said adjusting parts comprising a rod which is displaceable and fixable on a substantially vertical plane and for propping up the supporting means on the bottom of the sewer manhole. By this means a very simple supporting means is achieved which is easy to adjust in relation to the opening of the inlet pipe.

Moreover according to the invention the tightening member may comprise a threaded rod, one end of which is secured to the supporting means and the other end, onto which a counter nut is screwed, is inserted into a tube, which may be pressed against the wall of the sewer manhole and locked into any position in relation to the rod by means of the counter nut. By this means a tightening member is achieved which functions extremely simply and which is easily mounted by means of a suitable wrench. It is especially preferred that the tightening member according to the invention have an inner thread adapted to function in cooperation with the thread of the rod.

Furthermore according to the invention the blocking body may have an upward extending pin-like part having a knob or ball on top and the supporting means may have a fork-like member projecting from the lower part of the supporting means and which is preferably made of two sturdy, but somewhat flexible wires bent in a substantially S-shape, the knob of the blocking body being placed above the fork-like member with the pin-like part extending downwards between the prongs of the fork and prevented from gliding upwards by means of parts of the prongs. In this way a very preferred embodiment of the invention is achieved.

Figure 2:
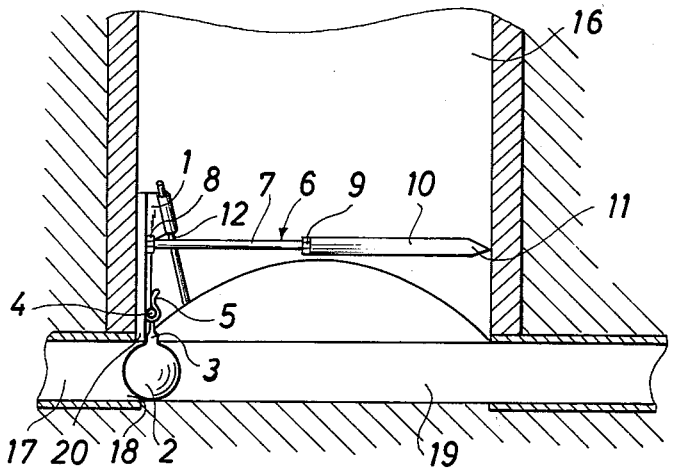
Figure 3:
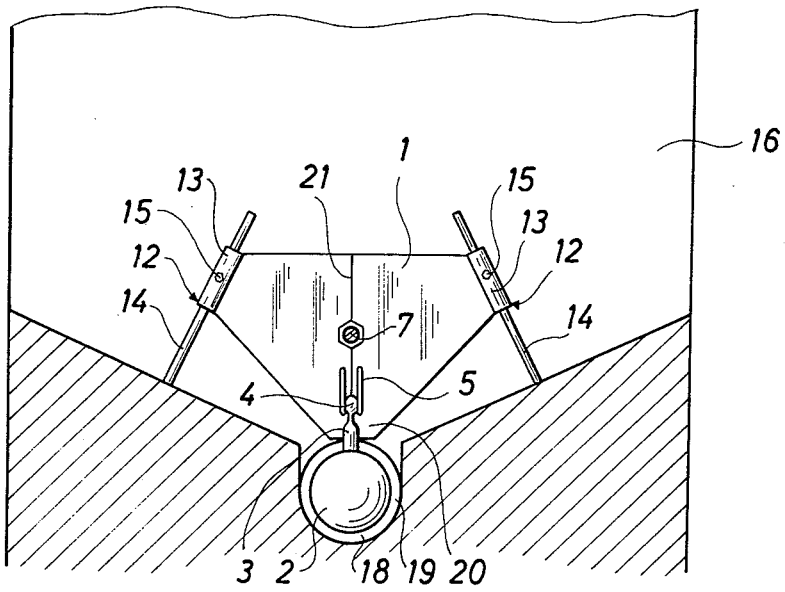

The invention will be described below with reference to the accompanying drawings, in which FIG. 1 is a perspective view of a preferred embodiment of a blocking device according to the invention with a T-shaped supporting means, FIG. 2 is a sectional view of the supporting means shown in FIG. 1 taken substantially along the line II—II in FIG. 1, the supporting means being mounted in a sewer manhole, partly shown in section, and FIG. 3 is a sectional view of a blocking device with a substantially triangular shaped supporting means taken perpendicular to the tightening member of the blocking device mounted in a manhole, partly shown in section.

The blocking device shown in FIGS. 1–3 comprises a supporting means 1 made of plate material from which a floatable blocking body is suspended from a pin-like part 3 extending upwards from the blocking body, so that it is able to swing freely. The pin-like part has a knob or ball 4 on top which is in mesh with a fork-like member projecting from the lower part of the supporting means 1. The pin-like part of the blocking body is located between the two prongs of the fork-like member which is made of two sturdy wires bent in an S-shape, so that the knob 4 of the blocking body may be conducted only under slight pressure down between the upper part of the fork and the supporting means, which together subsequently prevent the blocking body from coming out of mesh with the fork, if for instance the level of the water in the sewer manhole in which the blocking means is mounted should rise above the position of the fork.

A tightening member extends almost perpendicularly from the supporting means 1 and has the general reference number 6. The tightening member consists of a threaded rod 7, one end of which is screwed onto the supporting means by means of a nut 8 welded onto the supporting means. The other end is inserted into a tube 10 abutting a counter nut 9 which is screwed onto the rod 7. This tube 10 may have an inner thread fitting the thread on the rod 7. As shown in the embodiment of the invention in FIGS. 1 and 2 in the opposite end of the tube 10 from the counter nut may be constructed so as to form a point 11.

On each side the supporting means has adjustable parts 12 consisting of a piece of tubing 13 which is welded onto the supporting means. A displaceable rod 14 extends through the piece of tubing and may be locked in any position by means of a bolt 15 passing through the wall of the piece of tubing 13. As shown in FIGS. 1 and 3, the adjustable parts are constructed in such a way that the lower parts of the rods extend away from the center of the supporting means.

In order to use the blocking device, it is mounted as shown in FIGS. 2 and 3, in a sewer manhole in such a way that the supporting means is located vertically above the center of the opening 18 of an inlet pipe 17 and the blocking body 2 in its suspended state is centrally placed in the opening 18. In order to allow the blocking body to swing unhindered back and forth from its central location in the opening 18 of the inlet pipe 17, the diameter of the blocking body is made slightly smaller than the diameter of the opening. The precise placement of the supporting means above the opening of the inlet pipe is ensured by means of the adjustable parts, the rods 14 being brought to rest on the bottom of the manhole and fastened in the desired position by means of the bolts 15. When the supporting means has been correctly placed in relation to the opening of the inlet pipe, the entire blocking device is wedged into place by the tightening member which is made to abut the manhole wall opposite the opening by pushing the rod 10 out and locking it by means of the counter nut 9.

Although the blocking device as shown in the drawing is mounted in connection with a gully 19 running diagonally through the bottom of the sewer manhole, it may also be used in connection with other inlet pipes running into branch gullies in the sewer manhole.

As shown in FIG. 1, the supporting means is bent around a center line 21, so that only the area on the back of the supporting means adjacent to this line abuts the wall of the manhole when the blocking device is secured into place. As is especially apparent in FIG. 2, the supporting means and the pin-like part of the blocking body are constructed so that the lower part of the supporting means forms a stopping means 20 which limits the penetration depth of the blocking body into the opening 18 of the inlet pipe.

The blocking body may have many different shapes, but the most preferred are the pear-shape shown in FIG. 1 and the ball-shape shown in FIGS. 2 and 3. The supporting means, too, may have many different shapes, the most preferred shapes being the T-shape shown in FIGS. 1 and 2 and the more triangular shape shown in FIG. 3.

The invention has been described with reference to a preferred embodiment. Many changes may be made without deviating from the spirit and the scope of the invention as set forth in the appended claims. For instance, the blocking body may be suspended from the supporting means by means of a universal joint and the supporting means may have parts which limit the upward swinging of the blocking body if the water level in the manhole rises above the point of rotation of the blocking body.

I claim:

1. A blocking device for automatic blocking of the opening of an inlet pipe in a sewer manhole, comprising:
   - a supporting plate located above the opening of the inlet pipe;
   - a blocking body substantially freely pivotable from said supporting plate;
   - two displaceable and fixable rods, one located on each side of said plate and resting on the bottom of the sewer manhole to hold said plate above the inlet pipe opening; and
   - a tightening member adjustable in length, having one end secured to said supporting plate while the other end may be pressed against the wall of the manhole and locked into position holding said supporting plate against the wall of the manhole above the inlet pipe opening.

2. The blocking device of claim 1, wherein said tightening member has a threaded rod and a tube with an inner thread adapted to function in cooperation with the thread of the rod for adjustment of length.

3. The blocking device of claim 1, wherein the blocking body has an upward extending pin-like part with a knob or ball on top and there is a fork-like member projecting from the lower part of said supporting plate, said fork-like member being preferably made of two sturdy but flexible wires, bent in a substantially S-shape, said knob of said blocking body being located above said fork-like member with said pin-like part extending downwards between the prongs of said fork-like member and prevented from sliding upwards by means of parts of said prongs.

4. The blocking device of claim 3 wherein the blocking body is floatable and substantially ball or pear-shaped.

* * * * *